US008350834B2

(12) United States Patent
Ek

(10) Patent No.: US 8,350,834 B2
(45) Date of Patent: Jan. 8, 2013

(54) AMBIENT LIGHT DEPENDENT THEMES

(75) Inventor: Martin Ek, Dalby (SE)

(73) Assignee: Sony Ericsson Mobile Communications AB, Lund (SE)

( * ) Notice: Subject to any disclaimer, the term of this patent is extended or adjusted under 35 U.S.C. 154(b) by 942 days.

(21) Appl. No.: 11/940,588

(22) Filed: Nov. 15, 2007

(65) Prior Publication Data

US 2009/0128530 A1 May 21, 2009

(51) Int. Cl.
*G09G 3/38* (2006.01)

(52) U.S. Cl. ..... 345/207; 345/690

(58) Field of Classification Search ..... 345/102, 345/207, 690

See application file for complete search history.

(56) References Cited

U.S. PATENT DOCUMENTS

| | | | | |
|---|---|---|---|---|
| 4,965,574 | A | 10/1990 | Fukushima et al. | |
| 7,724,247 | B2 * | 5/2010 | Yamazaki et al. | 345/207 |
| 2004/0189610 | A1 | 9/2004 | Friend | |
| 2005/0037815 | A1 | 2/2005 | Besharat et al. | |
| 2006/0143298 | A1 | 6/2006 | Anttila et al. | |

FOREIGN PATENT DOCUMENTS

| | | | |
|---|---|---|---|
| EP | 0 801 342 | | 10/1997 |
| EP | 1 091 342 | | 4/2001 |
| EP | 1 513 329 | | 3/2005 |
| EP | 1 686 777 | A1 | 8/2006 |
| EP | 1 801 767 | A1 | 6/2007 |
| JP | 05-018767 | A | 1/1993 |
| JP | 05-250545 | A | 9/1993 |
| JP | 06-083287 | A | 3/1994 |
| JP | 07-038909 | A | 2/1995 |
| JP | 11-31-6566 | A | 11/1999 |
| JP | 11-352950 | A | 12/1999 |
| JP | 2000-098991 | A | 4/2000 |
| JP | 2000-250455 | A | 9/2000 |
| JP | 2003-076355 | A | 3/2003 |
| JP | 2004-294775 | A | 10/2004 |
| JP | 2005-242173 | A | 9/2005 |
| JP | 2006-091857 | A | 4/2006 |
| JP | 2007-004136 | A | 1/2007 |
| WO | WO 2005/104081 | A1 | 11/2005 |
| WO | WO 2006/072866 | A1 | 7/2006 |

OTHER PUBLICATIONS

International Search Report and Written Opinion dated Aug. 14, 2008, issued in corresponding international application No. PCT/EP2008/055220, 14 pages.

European Search Report corresponding to EP 08 736 621.7, mailed Nov. 23, 2011, 7 pages.

* cited by examiner

*Primary Examiner* — Regina Liang

(74) *Attorney, Agent, or Firm* — Harrity & Harrity, LLP

(57) ABSTRACT

A portable electronic device may include a display for displaying an image having different color or grey scale fields. Neighboring fields in the image may have different luminance. The portable electronic device may also include an ambient light detecting unit and a control unit. The control unit receives a luminance value corresponding to detected ambient light from the ambient light detecting unit, compares the luminance value with an ambient light level threshold and increases the difference in luminance between neighboring fields of an image being displayed by the display when the luminance exceeds the ambient light level threshold.

18 Claims, 2 Drawing Sheets

AMBIENT LIGHT DEPENDENT THEMES

TECHNICAL FIELD OF THE INVENTION

The present invention relates generally to the field of portable electronic devices and, more particularly, to a portable electronic device comprising a display, as well as to a method and computer program product for adjusting a display displaying an image through providing different color or grey scale fields.

DESCRIPTION OF RELATED ART

In portable electronic devices, for instance portable communication devices like cellular phones, there is a widespread use of color and grey scale displays displaying images to the user of the device. Such displays can nowadays provide sharp images that have many different colors and nuances of colors. However, because of the portability of the device, it is frequently used outdoors where a lot of ambient light like sunlight falls onto the display. When this happens, the displayed image is in many cases not able to be perceived properly. The various colors and nuances used can then often not be discerned properly by a user. This may lead to information in the image not being conveyed to the user. There is furthermore a waste of energy since a lot of effort is put into displaying various colors and nuances that cannot be separated from each other by a user. There is thus a need for improving on this situation when there is much ambient light.

SUMMARY OF THE INVENTION

Aspects of the present invention are directed towards providing a readable display when high ambient light conditions exist.

A first aspect described herein is directed towards a portable electronic device comprising: a display displaying an image through providing different color or grey scale fields, where neighboring fields have different luminance, an ambient light detecting unit, and a control unit configured to receive a luminance value corresponding to detected ambient light from the ambient light detecting unit, compare the luminance value with a first ambient light level threshold, and increase the difference in luminance between neighboring fields of an image displayed by the display in case the threshold is exceeded.

A second aspect described herein is directed towards a portable electronic device including the features of the first aspect, wherein the control unit when increasing the difference in luminance is configured to change from color or grey scale to black and white.

A third aspect described herein is directed towards a portable electronic device including the features of the first aspect, wherein the control unit is further configured to compare a luminance value with a second ambient light level threshold and to decrease the difference in luminance for neighboring fields for a previously increased difference in luminance in case the luminance value is below this second threshold.

A fourth aspect described herein is directed towards a portable electronic device including the features of the first aspect, wherein the control unit is further configured to also change the image being displayed by the display if the first ambient light level is exceeded.

A fifth aspect described herein is directed towards a portable electronic device including the features of the fourth aspect, further comprising at least one circumstance data provision unit, wherein the control unit when being configured to change the image being displayed is configured to receive circumstance data from the circumstance data provision unit and change the image based on the received circumstance data.

A sixth aspect described herein is directed towards a portable electronic device including the features of the fifth aspect, wherein one circumstance data provision unit is a clock and the circumstance data associated with this circumstance data provision unit is time data.

A seventh aspect described herein is directed towards a portable electronic device including the features of the fifth aspect, wherein one circumstance data provision unit is a temperature detecting unit and the circumstance data associated with this circumstance provision unit is temperature data.

An eighth aspect described herein is directed towards a portable electronic device including the features of the fifth aspect, wherein one circumstance data provision unit is a positioning unit and the circumstance data associated with this circumstance provision unit is position data.

A ninth aspect described herein is directed towards a portable electronic device including the features of the first aspect, wherein the display is a liquid crystal display.

A tenth aspect described herein is directed towards a portable electronic device including the features of the first aspect, wherein it is a portable communication device.

An eleventh aspect described herein is directed towards a portable electronic device including the features of the tenth aspect, wherein it is a cellular phone.

A twelfth aspect described herein is directed towards a method for adjusting a display displaying an image through providing different color or grey scale fields, where neighboring fields have different luminance, comprising the steps of: receiving a luminance value corresponding to detected ambient light, comparing the luminance value with a first ambient light level threshold, and increasing the difference in luminance between neighboring fields of an image displayed by the display in case the threshold is exceeded.

A thirteenth aspect described herein is directed towards a method including the features of the twelfth aspect, wherein the step of increasing the difference in luminance comprises changing from color or grey scale to black and white.

A fourteenth aspect described herein is directed towards a method including the features of the twelfth aspect, further comprising the steps of comparing a luminance value with a second ambient light level threshold and decreasing the difference in luminance for neighboring fields for a previously increased difference in luminance in case the luminance value is below this second threshold.

A fifteenth aspect described herein is directed towards a method including the features of the twelfth aspect, further comprising the step of changing the image being displayed by the display if the first ambient light level is exceeded.

A sixteenth aspect described herein is directed towards a method including the features of the fifteenth aspect, further comprising the step of receiving circumstance data and performing the step of changing the image being displayed based on the received circumstance data.

A seventeenth aspect described herein is directed towards a method including the features of the sixteenth aspect, wherein the circumstance data includes time data.

An eighteenth aspect described herein is directed towards a method including the features of the sixteenth aspect, wherein the circumstance data includes temperature data.

A nineteenth aspect described herein is directed towards a method including the features of the sixteenth aspect, wherein the circumstance data includes position data.

A twentieth aspect described herein is directed towards a computer program product for adjusting a display in a portable electronic device, which display is displaying an image through providing different colour or grey scale fields, where neighboring fields have different luminance, comprising: computer program code provided on a data carrier, configured to make the portable electronic device execute, when said program code is loaded in the portable electronic device, receive a luminance value corresponding to detected ambient light, compare the luminance value with a first ambient light level threshold, and increase the difference in luminance between neighboring fields of an image displayed by the display in case the threshold is exceeded.

Aspects of the invention described herein have a number of advantages. For example, aspects described herein enable the provisioning of information that can be seen when there is a lot of ambient light, thus improves the readability of a display in environments with high ambient light. In addition, aspects described herein are simple to implement since many of the units used to perform various aspects already exist in the hardware of many portable electronic devices. For example, in some implementations, no additional hardware may be required and only software may be needed to perform various of the functions/features described herein.

It should be emphasized that the term "comprises/comprising" when used in this specification is taken to specify the presence of stated features, integers, steps or components, but does not preclude the presence or addition of one or more other features, integers, steps, components or groups thereof.

BRIEF DESCRIPTION OF THE DRAWINGS

The present invention will now be described in more detail in relation to the enclosed drawings, in which.

DETAILED DESCRIPTION OF EMBODIMENTS

A portable electronic device consistent with aspects described herein will now be described in relation to a portable communication device in the form of a cellular phone, which is a preferred variation of such a device according to the present invention. The portable electronic device may be a portable communication device of some type other type, like a cordless phone, a personal digital assistant (PDA), a lap top computer or any other type of portable device communicating via radio waves. The portable electronic device can also be a gaming machine a notepad or any other type of portable electronic device.

Figure 1:
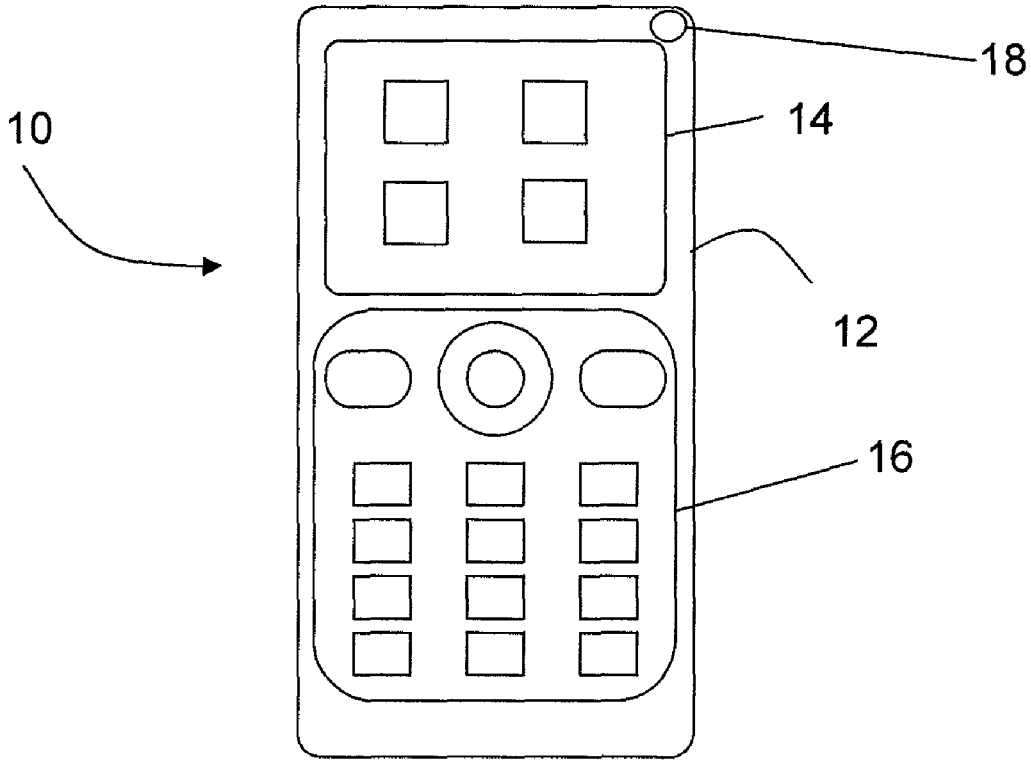
FIG. 1 schematically shows a front view of a portable electronic device in the form of a cellular phone, FIG. 2 schematically shows a block schematic of the some parts in the interior of the phone in FIG. 1.

FIG. 1 schematically shows a front view of a phone according to the invention. The phone 10 includes a casing 12 in which there is provided a display 14 and a keypad 16. Phone 10 also includes an ambient light detecting unit 18 which detects the luminance of the ambient light. The keypad 16 is used for entering information, such as making and accepting the reception of phone calls, selection of functions and responding to prompts and the display 14 is used for displaying information to a user of the phone 10, such as icons, functions and prompts. The phone 10 also includes an antenna, which is used for communication with other devices. However, the antenna may be built into the phone 10 and hence is not shown in FIG. 1. The phone 10 also includes a speaker for presenting sounds to a user, which speaker is also not shown. The display 14 may be a color display, such as a color liquid crystal display (LCD). As an alternative, it should be realized that the display 14 may be a grey scale display, i.e., a display showing different nuances of the color grey.

On the display 14 in FIG. 1, there is shown an image that is here made up of a number of icons (indicated as rectangles). The icons may, for example, be icons associated with a user interface of phone 10, such as an interface associated with making and receiving phone calls, sending and receiving text or electronic mail messages, playing music and/or games, taking pictures, surfing the Internet, etc. The image on the display 14 is furthermore made up of a number of color or grey scale fields, where neighboring fields have different luminance, where the difference in luminance may be provided as different colors or different nuances of the same colors. One field may here be provided as a part of an icon and a neighboring field as the background "behind" this icon. It should here also be realized that an icon can include different colors and different nuances of colors. It should also be realized that icons are mere examples of the information that may be presented in an image on a display. A display can present virtually any information in various fields having different colors or nuances of colors. Icons will be used in the following description in order to explain aspects of the present invention. However, the present invention is in no way limited to icons. For example, pictures or portions of pictures taken by a camera included in phone 10 (not shown in FIG. 1) may be subjected to the processing described herein. In addition, images received and displayed by phone 10, such as pictures sent to phone 10, images downloaded to phone 10 via a network, etc., may be subjected to the processing described herein.

Figure 2:
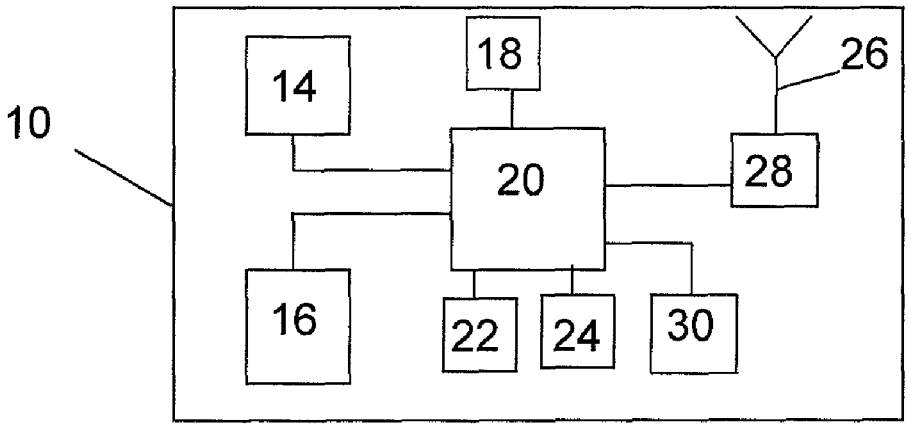

FIG. 2 shows a block schematic part of some units in the interior of the cellular phone 10 that may be relevant for the present invention. The phone 10 includes an antenna 26 connected to a communication unit in the form of a radio circuit 28 for enabling radio communication with a network or other devices. The radio circuit 28 is connected to a control unit 20. The control unit 20 is connected to the display 14 and to the keypad 16. The control unit 20 is also connected to the ambient light detecting unit 18 as well as to a number of circumstance data provision units 22, 24 and 30, each arranged to provide circumstance data to the control unit 20. A first circumstance data provision unit 22 is here a clock, a second circumstance data provision unit 24 is here a temperature detecting unit and a third circumstance data provision unit 30 is here a positioning unit, which may be a global positioning (GPS) unit. The first circumstance data provision unit 22 may here receive clock data from a network via the antenna 26 and radio circuit 28 in order to be synchronized with a system clock. The first circumstance data provision unit 22 here provides time data, the second circumstance data provision unit 24 here provides temperature data, which is preferably temperature data concerning the ambient temperature, and the third circumstance data provision unit 30 here provides position data, which is data regarding the position of the phone 10. It should be understood that aspects of the present invention may be realized without any or all of the circumstance data provision units. However, they are provided and described herein in order to be used in a variation of the present invention.

In low ambient light conditions, i.e., when the ambient light has low luminance levels, which is often the case indoors or outdoors at night, the image displayed by a display can show many fine details and nuances in various colors. In such situations, the human eye can separate different color levels even when the difference is small. This means that it is possible to show gradients and use for instance light grey text on dark grey background, which may be perceived by a user without any problems.

However, when a high ambient light condition exists, which is especially the case when using a phone outdoors during a sunny day, the contrast will be reduced and the user can not see the above-mentioned grey scale nuances as well as many other colors and nuances. This is due to the fact that the ambient light is reflected from the display surface. A lot of the information in the image will thus not be perceived by the user. This is wasteful regarding both energy consumption as well as regarding the information being presented. Aspects described herein are directed towards improving on this situation.

Figure 3:
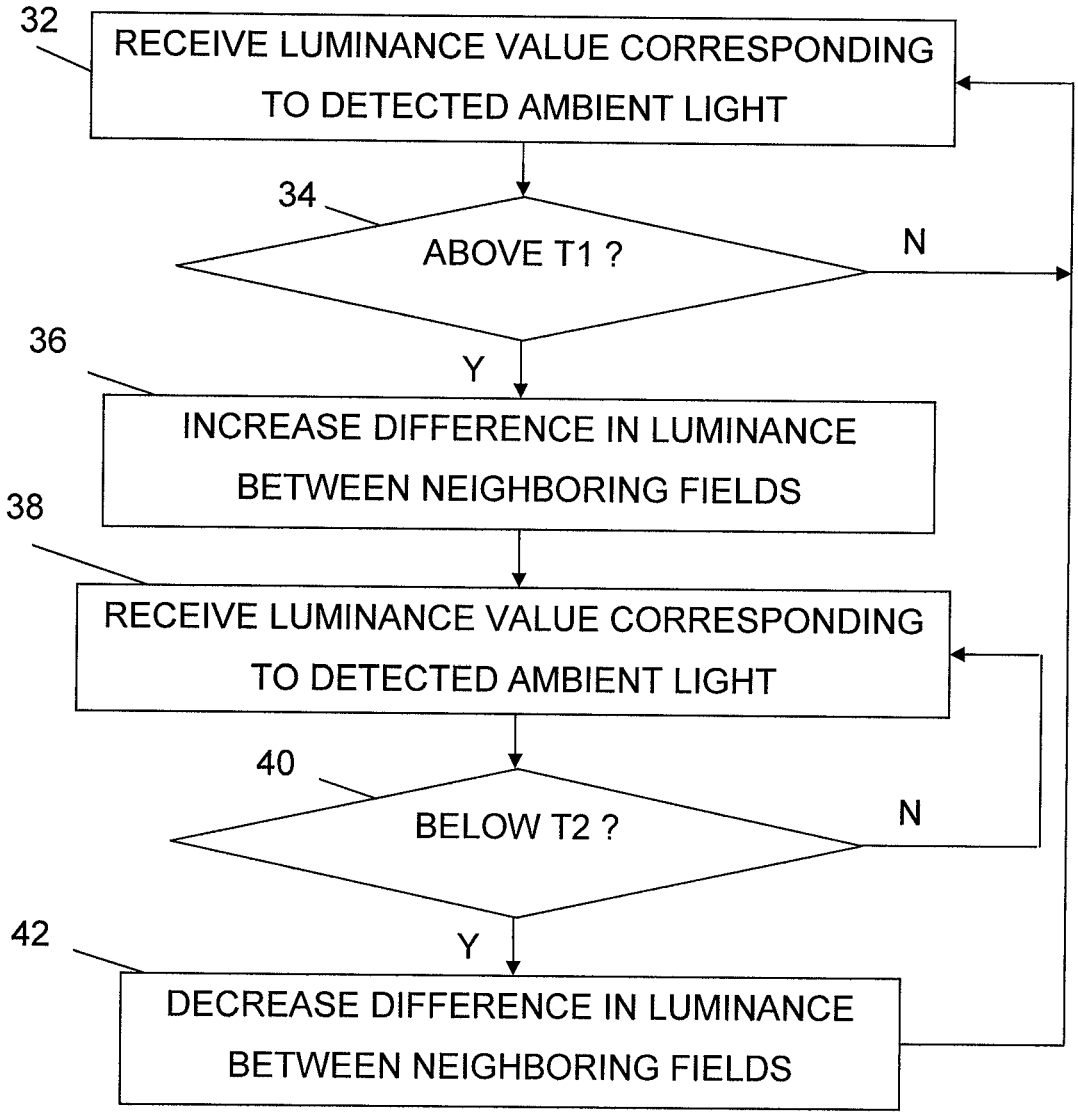
FIG. 3 shows a flow chart of a number of method steps being performed in the phone in FIG. 1, and, FIG. 4 a CD ROM disc on which program code for executing a method according to the invention is provided.

The functioning described herein according to an embodiment will now be described in relation to the previously described FIGS. 1 and 2 together with FIG. 3, which latter figure shows a flow chart of a number of method acts or steps performed in the phone according to a first embodiment.

According to a first embodiment, the ambient light detecting unit 18 detects the ambient light. It then provides luminance values corresponding to the detected ambient light to the control unit 20. The control unit 20 thus receives such a luminance value (act 32). The control unit 20 then proceeds and compares the received value with a first ambient light level threshold T1, which may be a threshold of 5000 lux (lx). This can be a suitable threshold, since there does not typically exist any normal indoor conditions with a luminance that is higher than 5000 lx. However, other thresholds may be used based on the particular circumstances. If this threshold is not exceeded (act 34—No), the control unit 20 continues to receive luminance values corresponding to detected ambient light from the ambient light detecting unit 18. If, however, the threshold T1 is exceeded (act 34—YES), the control unit 20 proceeds and increases the difference in luminance between neighboring color or grey scale fields in the image that is being displayed by the display 14 (block 36). This may, according to one variation of the present invention, typically be done through changing the colors or grey scale nuances to black and white and/or providing neighboring fields with luminances that differ considerably from each other (e.g., increase the difference in luminance between neighboring fields).

Taking the icons in FIG. 1 as an example, some of this change may be performed by increasing the difference in luminance between an icon and the background. Here it is also possible that some differences are evened out so that neighboring fields that previously had differing luminance are modified to have the same luminance, while others get their differences increased. In this way, a special ergonomic theme mainly using black and white may be presented to a user of the phone 10. As this is being done, the control unit 20 may again receive a luminance value from the ambient light detecting unit 18 (act 38). A received value is then compared with a second lower threshold T2. If the received value is not below this second ambient light level threshold T2 (act 40—No), the control unit 20 receives another luminance value (act 38), while if it is lower (act 40—Yes), the difference in luminance in the image being displayed by the display 14 is decreased (act 42). In one implementation, this decrease may be a decrease to the same difference that existed before the first level was exceeded, so that the same display image that was presented before the increase in luminance difference was performed is again displayed.

In this manner, it is possible to provide information that can be seen when there is a lot of ambient light. This means that when readability is low, ergonomics are prioritized. This also means that the "good looking" user interface that can be used in a darker environment does not need to be compromised because of the existence of the high ambient light condition. This enables aspects described herein to improve the readability of a display. Aspects described herein are furthermore simple to implement, since many of the units used already exist in the hardware of many portable electronic devices. For example, in some implementations, no new hardware may be required and only application software may be needed to provide the features described herein.

There are a number of variations and/or additions that can be made to the aspects described above. For example, it is possible that the above methods be applied as a user starts or turns on the phone 10, removes a keys lock function, or if a call is received or being made via the radio communication unit of the phone 10. The ergonomic theme could also be used for a displayed image by a user without comparing luminance values with the first threshold. This may be provided as an option for users having problems identifying the information provided in normal situations.

It should here also be mentioned that it is possible that selections are made regarding which information is to be displayed when a high ambient light condition exists. There may thus be a change in the image being displayed. Some icons may for instance be removed, others may be enlarged and some may even be added in a display image. A clock being shown on the display may for instance be enlarged when a high ambient light condition exists. Such a change may for instance be based on the habits of the user, where icons or other data relating to functions often used by the user of the phone may be retained and other icons or other data relating to functions that have not been used frequently may be removed. The information that is to be displayed may as an alternative be decided by circumstance data received from a circumstance data provision unit (e.g., one of unites 22, 24 or 30). Depending on any, some or all of time, position and temperature, the control unit 20 may for instance decide if the user is working or not and select which information, for instance which icons, should be presented based on this circumstance data when a high ambient light condition exists. It is furthermore possible that the second threshold is equal to the first threshold. However, in most circumstances, these thresholds should be different in order to avoid frequent switching between two levels. As another alternative, there may also be several thresholds (e.g., three or more), which when they are exceeded give rise to different increases in luminance difference. This may be done in order to adapt the display to various high ambient light conditions.

The control unit according to aspects described herein is preferably provided in the form of one or more processors or processing logic with corresponding memory containing the program code for performing its function.

Figure 4:
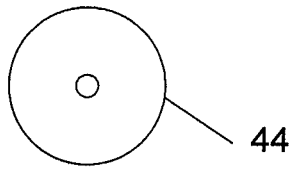

The program code mentioned above can also be provided on a data carrier such as a CD ROM disc 44 as depicted in FIG. 4 or an insertable memory stick or a universal serial bus (USB) memory device, which will perform aspects described herein when loaded into a phone having suitable processing capabilities. The program code can also be downloaded remotely from a server.

As has been described above, aspects of the present invention can be varied in a multitude of ways. The light detecting unit was, for instance, described as a separate entity. It should however be understood that it may as an alternative be a part of a camera or a display.

The scope of the invention is defined by the claims and their equivalents.

The invention claimed is:

1. A portable electronic device comprising:

a display configured to display an image comprising a plurality of icons or data through providing different color or grey scale fields, where neighboring fields have different luminance;

an ambient light detecting unit; and a control unit configured to:

receive a luminance value corresponding to detected ambient light from the ambient light detecting unit, compare the luminance value with a first ambient light level threshold, change content of the image, being displayed by the display, to obtain a changed image if the luminance value exceeds the first ambient light level threshold, the control unit being arranged to retain icons or data, of the plurality of icons or data, relating to functions often used by a user, and remove icons or data, of the plurality of icons or data, relating to functions infrequently used by the user, if the luminance value exceeds the first ambient light level threshold, and increase a difference in luminance between neighboring fields of the changed image, if the luminance value exceeds the first ambient light level threshold.

2. The portable electronic device according to claim 1, where the control unit, when increasing the difference in luminance, is configured to change from color or grey scale to black and white.

3. The portable electronic device according to claim 1, where the control unit is further configured to compare a luminance value with a second ambient light level threshold and to decrease the difference in luminance for neighboring fields for a previously increased difference in luminance, if the luminance value is below the second ambient light level threshold.

4. The portable electronic device according to claim 1, further comprising at least one circumstance data provision unit, where the control unit, when changing the content of the image being displayed, is configured to receive circumstance data from the at least one circumstance data provision unit and change the content of the image based on the received circumstance data.

5. The portable electronic device according to claim 4, where a first circumstance data provision unit, of the at least one circumstance data provision unit, comprises a clock and the circumstance data associated with the first circumstance data provision unit is time data.

6. The portable electronic device according to claim 4, where a first circumstance data provision unit, of the at least one circumstance data provision unit, comprises a temperature detecting unit and the circumstance data associated with the first circumstance provision unit is temperature data.

7. The portable electronic device according to claim 4, where a first circumstance data provision unit, of the at least one circumstance data provision unit, comprises a positioning unit and the circumstance data associated with the first circumstance provision unit is position data.

8. The portable electronic device according to claim 1, where the display is a liquid crystal display.

9. The portable electronic device according to claim 1, where the portable electronic device comprises a portable communication device.

10. The portable electronic device according to claim 9, where the portable communication device comprises a cellular phone.

11. A method for adjusting a display displaying an image comprising a plurality of icons or data through providing different color or grey scale fields, where neighboring fields have different luminance, the method comprising:

receiving a luminance value corresponding to detected ambient light;

comparing the luminance value with a first ambient light level threshold; and if the luminance value exceeds the first ambient light level threshold:

changing content of the image being displayed by the display, to obtain a changed image, changing the content of the image including:

retaining icons or data, of the plurality of icons or data, relating to functions often used by a user, and removing icons or data, of the plurality of icons or data, relating to functions infrequently used by the user, and increasing a difference in luminance between neighboring fields of the changed image.

12. The method according to claim 11, where the increasing the difference in luminance comprises changing from color or grey scale to black and white.

13. The method according to claim 11, further comprising comparing a luminance value with a second ambient light level threshold and decreasing the difference in luminance for neighboring fields for a previously increased difference in luminance, if the luminance value is below the second ambient light level threshold.

14. The method according to claim 11, further comprising receiving circumstance data, and performing the changing the content of the image being displayed based on the received circumstance data.

15. The method according to claim 14, where the circumstance data includes time data.

16. The method according to claim 14, where the circumstance data includes temperature data.

17. The method according to claim 14, where the circumstance data includes position data.

18. A non-transitory computer program product for adjusting a display in a portable electronic device, which display is displaying an image comprising a plurality of icons or data through providing different color or grey scale fields, where neighboring fields have different luminance, the non-transitory computer program product comprising computer program code, provided on a computer-readable medium, configured to make the portable electronic device execute, when said computer program code is loaded in the portable electronic device, a method comprising:

receiving a luminance value corresponding to detected ambient light;

comparing the luminance value with a first ambient light level threshold; and if the luminance value exceeds the first ambient light level threshold:

changing content of the image, being displayed by the display, to obtain a changed image, changing the content of the image including:

retaining icons or data, of the plurality of icons or data, relating to functions often used by a user, and removing icons or data, of the plurality of icons or data, relating to functions infrequently used by the user, and increasing a difference in luminance between neighboring fields of the changed image.

* * * * *

UNITED STATES PATENT AND TRADEMARK OFFICE

CERTIFICATE OF CORRECTION

PATENT NO. : 8,350,834 B2
APPLICATION NO. : 11/940588
DATED : January 8, 2013
INVENTOR(S) : Martin Ek It is certified that error appears in the above-identified patent and that said Letters Patent is hereby corrected as shown below:

Column 8, line 17 (claim 11, line 11) after “image” insert -- , --.

Signed and Sealed this
Nineteenth Day of February, 2013

Teresa Stanek Rea
*Acting Director of the United States Patent and Trademark Office*